US010378532B2

(12) United States Patent
Brown et al.

(10) Patent No.: US 10,378,532 B2
(45) Date of Patent: Aug. 13, 2019

(54) POSITIVE DISPLACEMENT PLUNGER PUMP WITH GAS ESCAPE VALVE

(71) Applicant: Baker Hughes Incorporated, Houston, TX (US)

(72) Inventors: Donn J. Brown, Broken Arrow, OK (US); Trevor A. Kopecky, Owasso, OK (US); Brown Lyle Wilson, Tulsa, OK (US)

(73) Assignee: Baker Huges, a GE Company, LLC, Houston, TX (US)

( * ) Notice: Subject to any disclaimer, the term of this patent is extended or adjusted under 35 U.S.C. 154(b) by 574 days.

(21) Appl. No.: 15/147,327

(22) Filed: May 5, 2016

(65) Prior Publication Data

US 2016/0369788 A1 Dec. 22, 2016

Related U.S. Application Data

(60) Provisional application No. 62/180,853, filed on Jun. 17, 2015.

(51) Int. Cl.
*E21B 43/12* (2006.01)
*F04B 17/03* (2006.01)
(Continued)

(52) U.S. Cl.
CPC ..... *F04B 47/06* (2013.01); *E21B 43/128* (2013.01); *F04B 7/04* (2013.01); *F04B 17/03* (2013.01);
(Continued)

(58) Field of Classification Search
CPC ..... F04B 47/06; F04B 53/126; F04B 53/06; F04B 53/12; F04B 53/16; F04B 53/1087;
(Continued)

(56) References Cited

U.S. PATENT DOCUMENTS 1,378,949 A 5/1921 Hahn
1,459,368 A 6/1923 Henshaw
(Continued)

OTHER PUBLICATIONS

Sep. 12, 2016 International Search Report and Written Opinion of related PCT/US2016/037245.

*Primary Examiner* — Devon C Kramer
*Assistant Examiner* — Christopher J Brunjes
(74) *Attorney, Agent, or Firm* — Bracewell LLP; James E. Bradley

(57) ABSTRACT

A well pump assembly has a barrel, a standing valve at an upper end of a standing valve chamber, and a plunger. A travelling valve admits well fluid into the barrel during a fill stroke. The travelling valve closes during a power stroke so that the plunger pushes well fluid from the barrel into the standing valve chamber. A gas release port extends from the standing valve chamber to the exterior of the pump assembly. A check valve in the gas release port has an outward flow blocking position for blocking liquid well fluid in the standing valve chamber from exiting through the gas release port while the plunger is in the power stroke. The cheek valve has a gas release position that enables gas present in the standing valve chamber to flow out the gas release port while the plunger is in the power stroke.

12 Claims, 4 Drawing Sheets

(51) Int. Cl.

| | |
|---|---|
| ***F04B 53/06*** | (2006.01) |
| ***F04B 47/06*** | (2006.01) |
| ***F04B 53/10*** | (2006.01) |
| ***F04B 53/16*** | (2006.01) |
| ***F04B 7/04*** | (2006.01) |
| ***F04B 53/12*** | (2006.01) |

(52) U.S. Cl.
CPC ..... *F04B 53/06* (2013.01); *F04B 53/1002* (2013.01); *F04B 53/1087* (2013.01); *F04B 53/12* (2013.01); *F04B 53/126* (2013.01); *F04B 53/16* (2013.01)

(58) Field of Classification Search
CPC ..... F04B 53/1002; F04B 53/14; F04B 7/04; F04B 17/03; F04B 19/11; E21B 43/128; E21B 43/121; E21B 43/122; E21B 34/08; E21B 43/126
USPC ..... 417/555.2
See application file for complete search history.

(56) References Cited

U.S. PATENT DOCUMENTS

| | | | | |
|---|---|---|---|---|
| 1,550,747 | A | 8/1925 | Rinard | |
| 1,639,734 | A | 8/1927 | Jones | |
| 2,229,541 | A | 1/1941 | Zublin | |
| 4,490,095 | A | 12/1984 | Soderberg | |
| 4,509,379 | A | 4/1985 | Westmoreland | |
| 5,054,510 | A * | 10/1991 | Ribeiro | E21B 34/06 137/199 |
| 6,273,690 | B1 | 8/2001 | Fischer et al. | |
| 8,196,657 | B2 | 6/2012 | Kennedy | |
| 2007/0110598 | A1 * | 5/2007 | Jacobs | F04B 35/045 417/397 |
| 2013/0195702 | A1 | 8/2013 | Strahov et al. | |
| 2013/0302193 | A1 * | 11/2013 | Gabdullin | E21B 43/127 417/440 |
| 2015/0176574 | A1 | 6/2015 | DeArman | |
| 2016/0010640 | A1 | 1/2016 | Tetzlaff | |

* cited by examiner

POSITIVE DISPLACEMENT PLUNGER PUMP WITH GAS ESCAPE VALVE

BACKGROUND OF THE INVENTION

1. Field of Invention

The present disclosure relates to downhole pumping systems submersible in well bore fluids. More specifically, the present disclosure relates to an electrical submersible pump system having a positive displacement pump equipped with a gas escape valve.

2. Description of Prior Art

Submersible pumping systems are often used in hydrocarbon producing wells for pumping fluids from within the wellbore to the surface. These fluids are generally liquids made up of produced liquid hydrocarbon and often water. One type of system used in this application employs an electrical submersible pump ("ESP") system. ESP systems include a pump operated by an electrically powered motor for pressurizing the fluid. Pressurized fluid is discharged from the pump and into production tubing, or by other means, for conveyance to surface. Often, electrical power may be supplied to the motor via an electrical power cable from the surface that is strapped alongside the tubing. The power cable is sometimes part of an umbilical that extends from the surface; the umbilical can also include control lines for operation of completion equipment disposed in the wellbore below the BSP system. The ESP system is sometimes disposed at the end of a length of tubing deployed in the wellbore, with its discharge coupled to the tubing inlet.

The types of submersible pumps used in wellbores generally include centrifugal pumps, progressive cavity pumps, reciprocating pumps, and positive displacement pumps. Centrifugal and progressive cavity pumps are usually equipped with a rotating impeller or helical rotor to urge the fluid from downhole to the surface. The reciprocating pumps and positive displacement pumps typically operate by reciprocating a sucker rod or piston rod to force wellbore liquid uphole. In any of these designs, vapor lock can occur within the pump when a sufficient amount of gas accompanies the liquid, so that forces applied to the liquid merely compress the gas rather than causing the fluid to be lifted to surface.

SUMMARY OF THE INVENTION

A well pump assembly has a barrel and a standing valve at an upper end of a standing valve chamber that is in fluid communication with an interior of the barrel. A plunger, carried reciprocally and sealingly in the barrel, moves between a power stroke and a fill stroke. A travelling valve, carried by the plunger for reciprocating movement therewith, admits well fluid through the travelling valve into the barrel during the fill stroke. The travelling valve closes during the power stroke so that the plunger pushes well fluid from the barrel into the standing valve chamber and through the standing valve for conveyance up the production tubing. A gas release port extends from the standing valve chamber to the exterior of the pump assembly. A check valve in the gas release port has an outward flow blocking position for blocking liquid well fluid in the standing valve chamber from exiting through the gas release port while the plunger is in the power stroke. The check valve has a gas release position that enables gas present in the standing valve chamber to flow out the gas release port while the plunger is in the power stroke.

The gas release position occurs in response to pressure within the standing valve chamber being inadequate to open the standing valve during the power stroke.

The check valve may have an inward flow blocking position that blocks well fluid on the exterior of the pump assembly from entering the standing valve chamber through the gas release port while the plunger is in the fill stroke.

The check valve preferably comprises an outward flow blocking seat in the gas release port and a movable element path in the gas release port that leads upward relative to the axis to the outward flow blocking seat. A movable element moves along the movable element path. The movable element is pushed upward along the movable element path into sealing engagement with the outward flow blocking seat in response to liquid well fluid pressure in the standing valve chamber during the power stroke. If the gas content in the well fluid in the standing valve chamber is sufficiently high, the gas will flow around the movable element and out the outward flow blocking seat during the power stroke until the gas content drops sufficiently to cause the liquid well fluid pressure to push the movable element into sealing engagement with the outward flow blocking seat. The movable element path has a greater cross-sectional area than a cross-sectional area of the movable element, providing a gas release passage around the movable element while the movable element is out of sealing engagement with the outward flow blocking seat.

The check valves is free of any biasing spring that biases the check valve to the outward flow blocking position. The check valve may also have an inward flow blocking seat downward from the outward flow blocking seat. The movable element seals against the inward flow blocking seat while the plunger is in the fill stroke.

In the embodiment shown, the power stroke of the plunger is in a downward direction relative to the axis. The fill stroke is in an upward direction relative to the axis. A housing encloses the barrel and is separated from the barrel by an annulus that is in fluid communication with the standing valve chamber. A barrel outlet port extends from an interior of the barrel to the annulus.

BRIEF DESCRIPTION OF DRAWINGS

Some of the features and benefits of the present invention having been stated, others will become apparent as the description proceeds when taken in conjunction with the accompanying drawings, in which.

Figure 1:
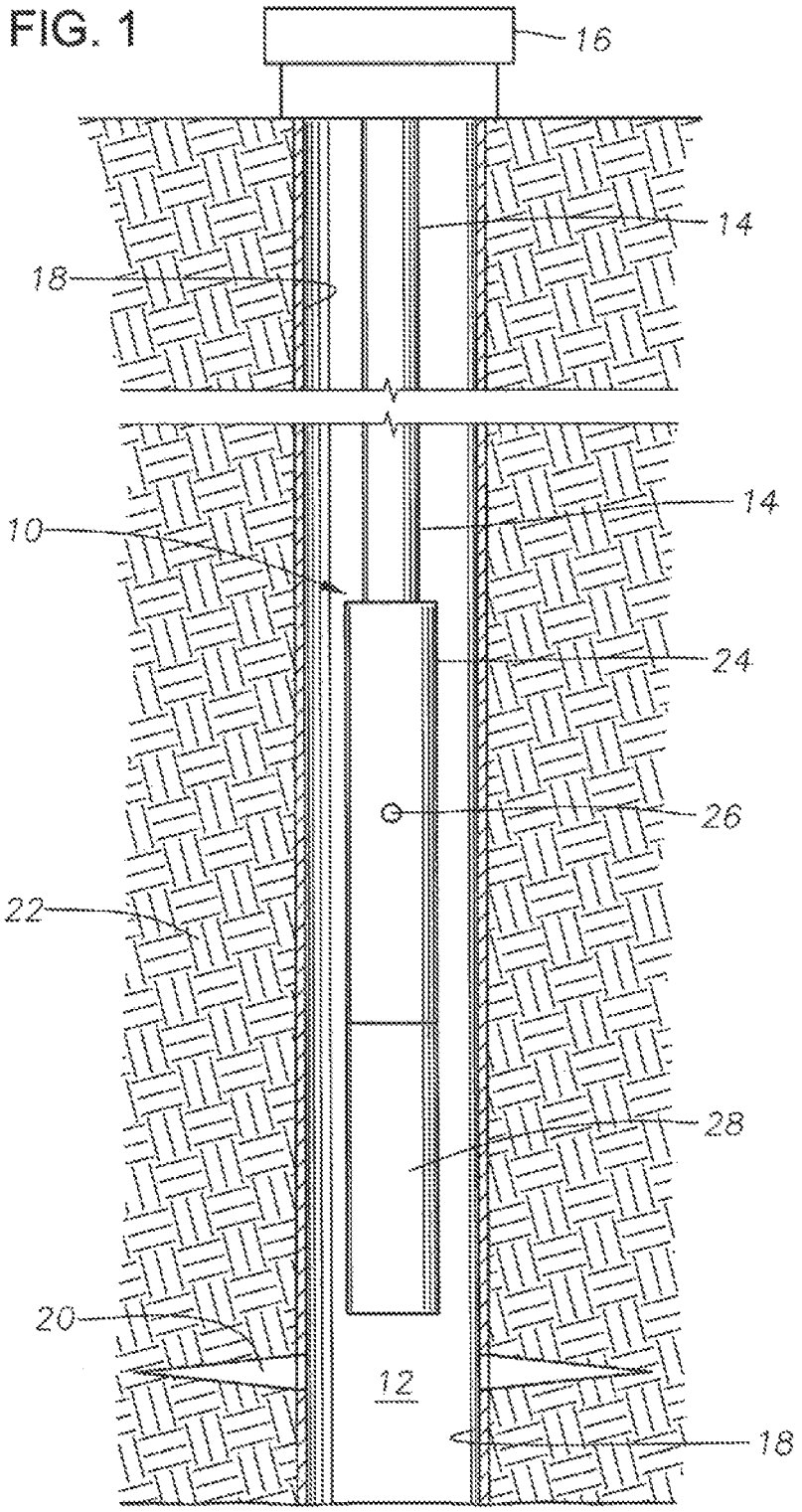
FIG. 1 is a side partial sectional view of an ESP system in accordance with this disclosure and disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough find complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is an example of an electrical submersible pumping (ESP) assembly 10 disposed in a wellbore 12 for pumping fluids from wellbore 12. Production tubing 14 is shown mounted on an upper end of ESP assembly 10, and provides a conveyance means for sending liquid from within wellbore 12 to a wellhead assembly 16 shown mounted on surface at opening of wellbore 12. Wellbore 12 is lined with casing 18; perforations 20 project radially outward from wellbore 12 through casing 18 and into a subterranean formation 22 in which wellbore 12 is formed. Thus, fluid from within formation 22 propagates through perforations 20 and into wellbore 12 where it can then be lifted by ESP assembly 10 to wellhead assembly 16.

In the illustrated example, the ESP assembly 10 includes a pump assembly 24 on an end of assembly 10 adjacent tubing 14. An inlet 26 is provided on pump assembly 24. A motor 28 is shown included with ESP assembly 10 and on an end of pump assembly 24 distal from its connection to tubing 14.

Figure 2:
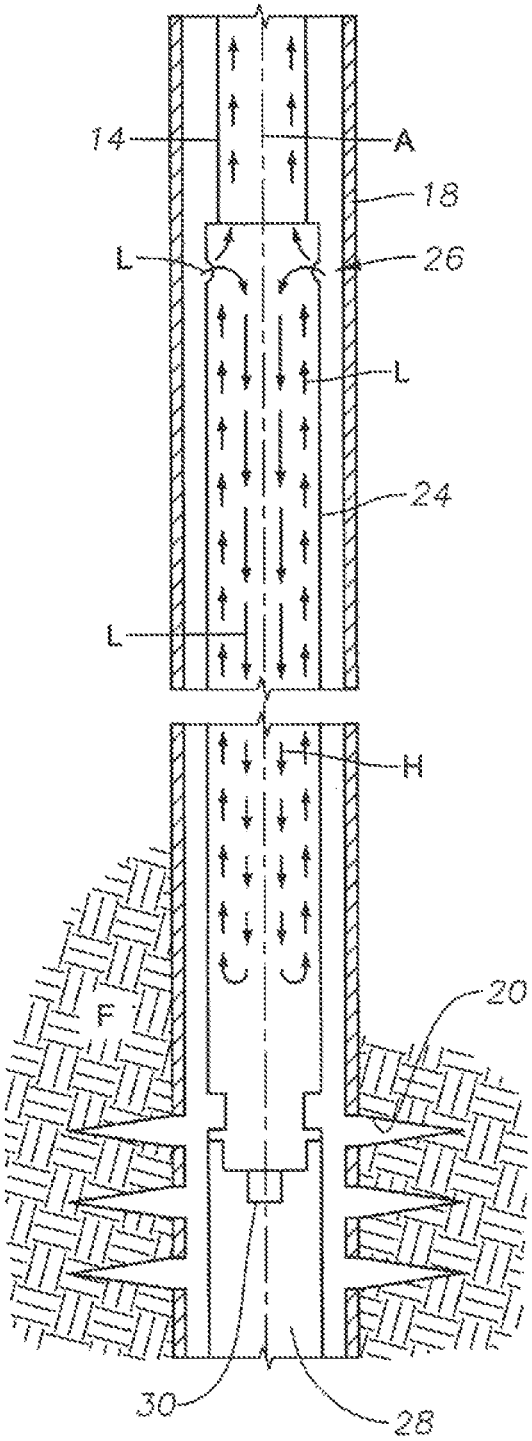
FIG. 2 is a schematic view of the pump of the ESP system of FIG. 1 illustrating a well fluid flow path during a down-stroke.

Referring to the schematic of FIG. 2, pump assembly 24 may be a reverse acting piston pump assembly having an axis "A" that is vertical if the portion of wellbore containing pump assembly 24 is vertical. Pump assembly 24 may alternately operate in inclined and horizontal wellbores. Motor 28 is operable to axially move a connecting rod 30 of the pump assembly 24 in a reciprocating manner. Motor 28 can be a submersible, rotary electric motor having a rotary to linear motion converter, and can be powered by an electric cable (not shown) extending to the surface location. Alternately, motor 28 can be a hydraulic actuator, electrical linear motor, or other actuators operable to induce linear reciprocating motion of connecting rod 30.

In operation of this example of pump assembly 24, motor 28 is activated to move connecting rod 30 alternatingly on a down-stroke (in a down-hole direction) and on an upstroke (in an up-hole direction). As described in greater detail below, the down-stroke draws well fluid into the interior of pump assembly through inlet ports 26. The well fluid moving toward the inlet ports 26 between casing 18 find pump assembly 24 along arrows "L" defines a relatively low pressure flow. The wellbore fluid reverses direction upon entering the inlet ports 26. This reversal can induce gas to separate from liquid in the wellbore fluid, similar to the operation of a reverse flow gas separator, to minimize gas entering the pump assembly 24. The down-stroke also provides the pressure to discharge the well fluid from the pump assembly 24 into the production tubing 14. The well fluid moving into production tubing 14 along arrows "H" defines a relatively high pressure flow. During the upstroke, well fluids are exchanged within the pump assembly 24.

Figure 3A:
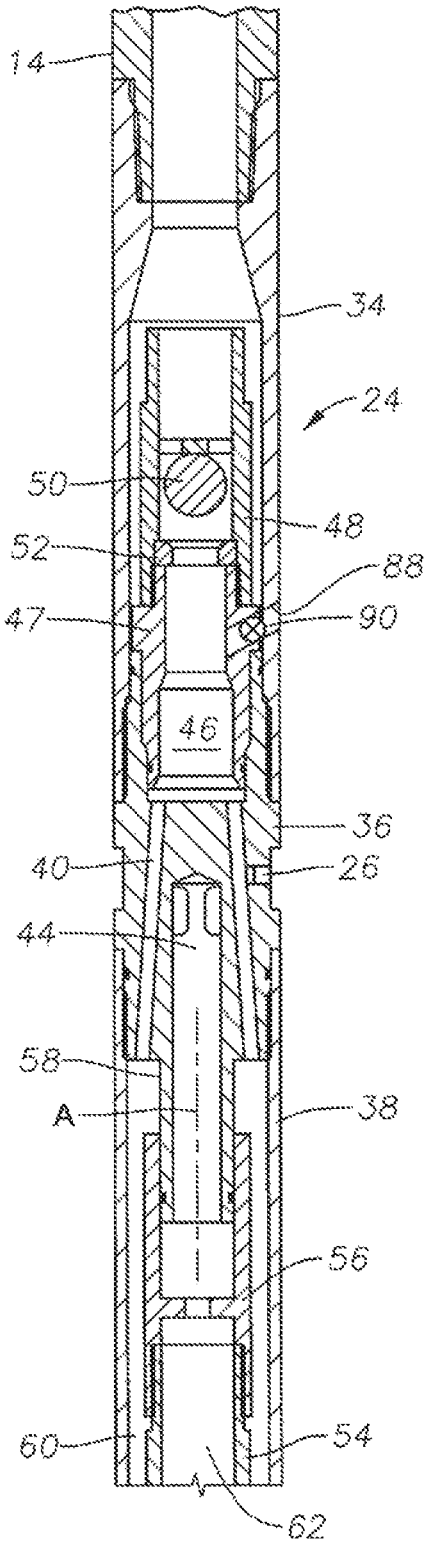
FIGS. 3A and 3B comprise a side sectional view of the pump of the ESP system of FIG. 1.

Referring to FIG. 3A, in this example, pump assembly 24 has a discharge adapter 34 on an upper end that typically connects to production tubing 14 leading upward to a wellhead assembly. A pump head 36 secures with threads to discharge adapter 34. A cylindrical pump housing 38 secures with threads to pump head 36. Well fluid discharge ports 40 extend through pump head 36 from a lower end to an upper end. Well fluid intake port 26 extends from the exterior of pump head 36 to a central cavity 44 in pump head 36. Central cavity 44 has a closed upper end within pump head 36.

Discharge ports 40 lead upward to a standing valve chamber 46. A standing valve 48 at the upper end of standing valve chamber 46 secures to a standing valve adapter 47. Standing valve adapter 47 secures to an upper end of pump head 36 within discharge adapter 34. Standing valve 48 has a lower seat 52 with a ball 52 above. When the pressure on ball 50 from above is higher than below, ball 50 closes, blocking downward flow from production tubing 14 into standing valve chamber 46 and discharge ports 40. When the pressure on ball 50 from above is less than below, ball 50 opens to allow upward flow of well fluid from discharge ports 40 out the upper end of discharge adapter 34 into production tubing 14. Standing valve 48 has no effect on well fluid inlet 26, which may remain open at all times.

A cylinder or barrel 54 concentrically locates within pump housing 38. A collar 56 on the upper end of barrel 54 sealingly couples barrel 54 to a depending isolation tube 58 extending downward from pump head cavity 44. Barrel 54, which does not move within pump housing 38, defines an annulus or annular passageway 60 between barrel 54 and pump housing 38. Barrel 54 has an open bore 62 that is coaxial with a longitudinal axis A of pump 24. Collar 56 places well fluid from pump head cavity 44 in fluid communication with barrel bore 62.

Figure 3B:
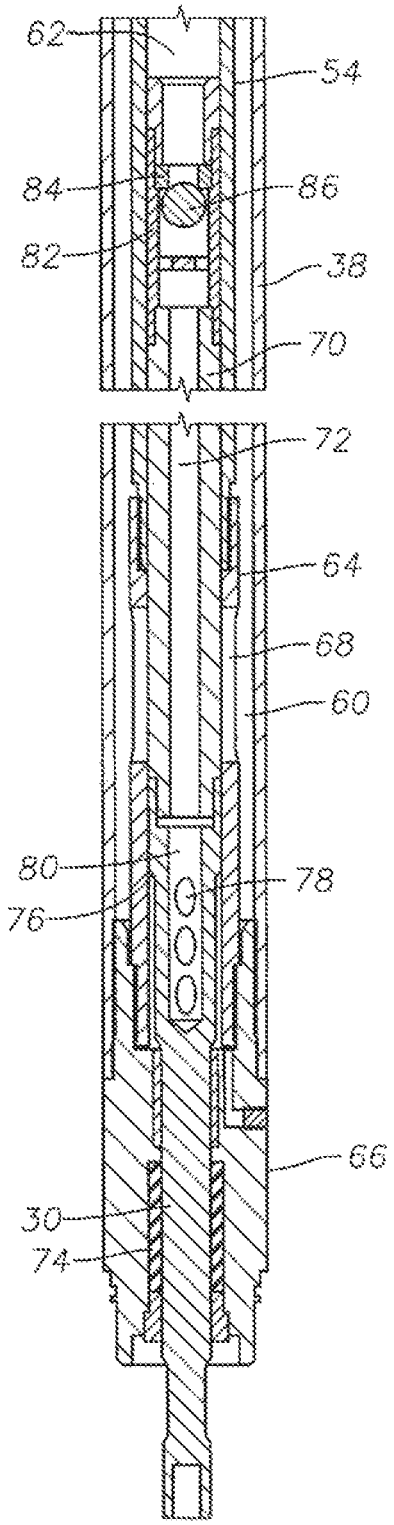

Referring to FIG. 3B, a lower end of barrel 54 connects to a barrel adapter 64, which may be considered to be a part of barrel 54. Barrel adapter 64 has a lower end that secures to a pump base 66, which secures to the lower end of pump housing 38. Redirect or barrel outlet ports 68 extend through barrel adapter 64, creating a flow path for well fluid in barrel bore 62 to flow outward into a lower portion of annular passageway 60.

A plunger 70 slides sealingly within barrel bore 62 along axis A. Plunger 70 has an axial plunger passage 72 extending therethrough. Plunger 70 is movable from the lower end of barrel bore 62 to the upper end. Connecting rod 30 has an upper end that secures to plunger 70 for moving plunger 70 in unison between an upstroke or fill stroke and a down-stroke or power stroke. Seals 74 seal between connecting rod 30 and pump base 66. The upper end of connecting rod 30 has the same outer diameter as plunger 70. A downward lacing shoulder 76 on connecting rod 30 separates the larger diameter portion of connecting rod 30 from a lower smaller outer diameter portion of connecting rod 30. Shoulder 76 may be considered to be a lower end of plunger 70 in that any fluid in barrel 54 below shoulder 76 will be pushed downward during the down-stroke.

In this example, connecting rod 30 has plunger ports 78 located within a connecting rod cavity 80 at the upper end of connecting rod 30. Plunger ports 78 communicate well fluid in plunger passage 72 with well fluid in barrel bore 62. Alternately, plunger ports 78 could be located directly in the side wall of plunger 70.

A traveling valve 82 mounts to an upper end of plunger 70 for axial movement therewith. Traveling valve 82 has an upper seal 84 that is engaged by a movable sealing element or ball 86 while plunger 70 is in down-stroke movement. The engagement closes traveling valve 82, causing downward movement of plunger 70 to push well fluid located in barrel bore 62 below plunger 70 outward. The outward flowing well fluid will flow through redirect ports 68 into annular passageway 60 until the lower end of plunger 70 passes below redirect ports 68. During the upstroke, traveling valve 82 opens, allowing well fluid that has entered barrel bore 62 above plunger 70 to flow through traveling valve 82 and out plunger ports 78 into the portion of barrel bore 62 below plunger 70.

During the down-stroke of plunger 70, well fluid is pumped upward in annular passageway 60 out discharge adapter 34 to lift the column of well fluid in production tubing 14. The down-stroke may be considered to be a power stroke, and during the down-stroke, plunger 70 moves in an opposite direction to the flow of well fluid into production tubing 14. During the down-stroke, traveling valve 82 closes. Plunger 70 pushes well fluid that previously entered barrel bore 62 below plunger 70 out redirect ports 68 until shoulder 76 passes below redirect ports 68 near the end of the down-stroke. The well fluid flowing into annular passageway 60 will be pushed upward through discharge ports 40 into standing valve chamber 46 and through standing valve 48, which is normally open during the down-stroke.

During the upstroke, traveling valve 82 will open, allowing fluid that enters intake port 26 to flow into bore barrel 62 above plunger 70. This incoming well fluid flows downward through traveling valve 82 into plunger passage 72. The incoming well fluid flows downward in plunger passage 72 out plunger ports 78 into barrel bore 62 below plunger 70. The well fluid entering barrel bore 62 will be in fluid communication with the well fluid in annular passageway 60. The upstroke thus replenishes well fluid in barrel bore 62 below plunger 70. Standing valve 48 will be closed during the upstroke, blocking downward flow of well fluid in production tubing 14. When plunger 70 reaches the top of the upstroke, connecting rod 30 reverses, starting another down-stroke.

If there is sufficient gas in the well fluid being pumped, the gas may accumulate in standing valve chamber 46. Because of the compressibility of gas, the pressure in standing valve chamber 46 possibly may not reach a high enough level during the down-stroke to open standing valve 48. If so, pump 24 may be considered to be gas locked. Even if pump 24 does not reach a gas locked condition, the efficiency of the pump may suffer when a small volume gas in the well fluid continually absorbs the volume change by compressing and expanding, rather than passing through pump 24 into production tubing 14.

To overcome gas accumulation problems, one or more gas release ports 88 (only one shown) extend from standing valve chamber 46 to the exterior of pump 24. In this example, gas release port 88 extends through a side wall of standing valve adapter 47 and through a side wall of discharge adapter 34. A check, valve 90 mounts in gas release port 88. Check valve 90 closes when the pressure within standing valve chamber 46 reaches a selected level. Closing check valve 90 restricts liquid well fluid from flowing out gas release port during the down-stroke of plunger 70. Check valve 90 also has a gas release position dial allows gas entrained in the liquid well fluid in standing valve chamber 46 to flow out gas release port 88. Check valve 90 greatly restricts any outward flow of liquid well fluid while in the gas release position.

Check valve 90 optionally may have an inward flow blocking position that prevents well fluid on the exterior of pump 24 from flowing through gas release port 88 into standing valve chamber 46. The optional inward flow blocking position would be utilized if one wishes to direct all incoming well fluid through intake port 26.

Figure 4:
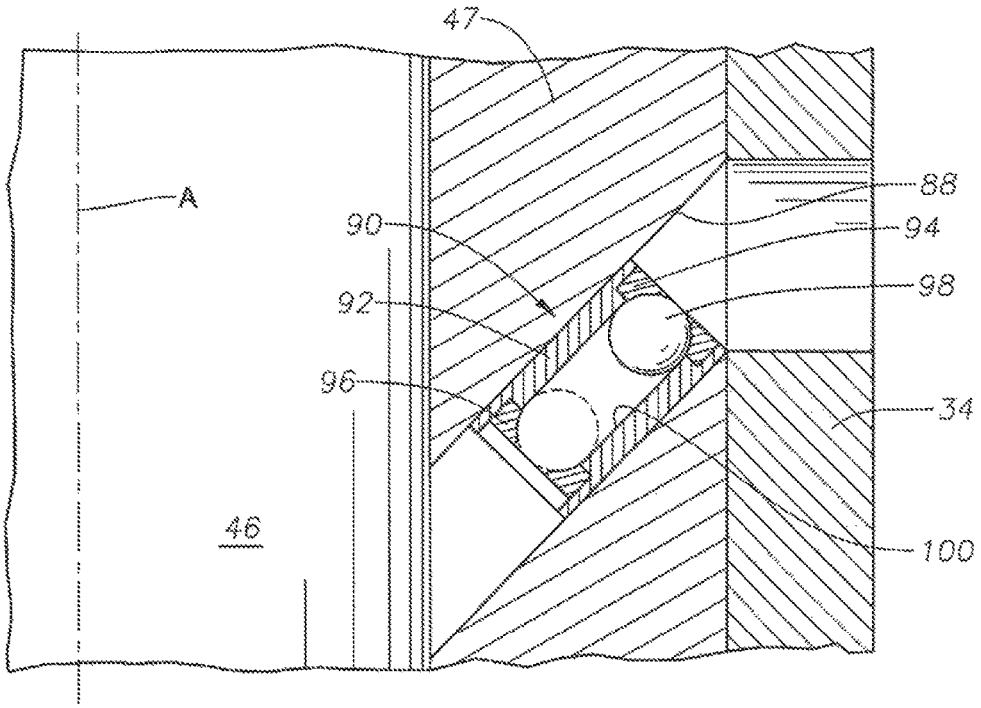
FIG. 4 is an enlarged view of a gas escape valve of the pump of FIGS. 3A and 3B.

FIG. 4 shows one example of check valve 90. In this embodiment, at least the part of gas release port 88 in standing valve adapter 47 inclines upward and outward relative to axis A. The outer portion of gas release port 88, which is the portion in discharge adapter 34, is shown as extending radially, but it could alternately extend upward and outward.

Check valve 90 may have a tubular body 92 that secures by threads or the like in gas release port 88. Seals (not shown) will seal body 92 in gas release port 88. An outward flow blocking seat 94 is located at the outer end of body 92, and it may be either integrally formed with body 92 or secured otherwise, such as by threads. An inward flow blocking seat 96 optionally may be located at the inner end of body 92.

A movable seal element, such as a spherical ball 98 is carried in body 92 on a ball path 100. Ball 98 is smaller in cross-sectional dimension than the cross-sectional area of ball path 100. When ball 98 is sealingly engaging outward flow blocking seat 94, as shown, it will block all outward flow of well fluid through gas release port 88. When ball 98 is sealingly engaging inward flow blocking seat 96, as shown by the dotted lines, it will block all incoming flow of well fluid through gas release port 88. In order to move from sealing engagement with inward flow blocking seat 96 to sealing engagement with outward flow blocking seat 94, ball 98 must be pushed upward and outward along ball path 100 by pressure of well fluid in standing valve chamber 46.

The gas release position occurs when the pressure in standing valve chamber 46 is inadequate to push ball 98 upward and outward to seal against outward flow blocking seat 94. This pressure may be greater than the hydrostatic pressure of well fluid on the exterior of pump 24, but not high enough to lift standing valve ball 52 (FIG. 3A). In the gas release position, ball 98 may be located anywhere along ball path 100. While in this position, gas is free to flow around ball 98 and out gas release port 88. As the gas (lows out, the pressure in standing valve chamber 46 increases due to the power stroke occurring with plunger 70 (FIG. 3A).

Because the liquid in the well fluid would tend create a drag force on ball 98, it would not tend to flow past ball 98 while ball 98 is not yet sealing with outward flow blocking seat 94. Rather once the pressure in standing valve chamber 46 is high enough, the liquid would push ball 98 upward and outward into sealing engagement with outward flow blocking seat 94. Gas flowing around ball 98 within ball path 100 does not create a significant drag force on ball 98. No spring biasing ball 98 in either direction is required in this embodiment.

Check valve 90 could differ in several ways from the embodiment shown. For example, body 92 could be eliminated and outward flow blocking seat 94 secured to threads in gas release port 88. Ball path 100 could be part of gas release port 88. A stop could be used in place of inward flow blocking seat 96. Also, check valve 90 could be used with other types of pumps other than the one shown.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A well pump assembly, comprising:

a barrel having an axis;

a standing valve acting as a discharge valve, the standing valve having a ball above a seat at an upper end of a standing valve chamber, the standing valve chamber being above the barrel and in fluid communication with an interior of the barrel, the standing valve adapted to be in fluid communication with an interior of a string of production tubing;

a plunger carried reciprocally and sealingly in the barrel between a downward moving power stroke and an upward moving fill stroke;

a travelling valve carried by the plunger below the standing valve for reciprocating movement therewith, the travelling valve admitting well fluid through the travelling valve into the barrel during the fill stroke, the travelling valve closing during the power stroke so that the plunger pushes well fluid from the barrel into the standing valve chamber and discharges the well fluid through the standing valve for conveyance up the production tubing;

a gas release port extending from the standing valve chamber below the ball and seat of the standing valve to the exterior of the pump assembly; and a check valve in the gas release port, the check valve having an outward flow blocking position for blocking liquid well fluid in the standing valve chamber from exiting through the gas release port while the plunger is in the power stroke, and the check valve having a gas release position that enables gas present in the standing valve chamber to flow out the gas release port while the plunger is in the power stroke.

2. The pump assembly according to claim 1, wherein:

the gas release position occurs in response to pressure within the standing valve chamber being inadequate to lift the ball above the seat of the standing valve during the power stroke.

3. The pump assembly according to claim 1, wherein:

the check valve has an inward flow blocking position that blocks well fluid on the exterior of the pump assembly from entering the standing valve chamber through the gas release port while the plunger is in the fill stroke.

4. The pump assembly according to claim 1, wherein the check valve comprises:

an outward flow blocking seat in the gas release port;

a movable element path in the gas release port that leads upward relative to the axis to the outward flow blocking seat;

a movable element movable along the movable element path; wherein the movable element is pushed upward along the movable element path into sealing engagement with the outward flow blocking seat in response to liquid well fluid in the standing valve chamber during the power stroke; and if the gas content in the well fluid in the standing valve chamber is sufficiently high, the gas will flow around the movable element and out the outward flow blocking seat during the power stroke until the gas content drops sufficiently to cause the liquid well fluid to push the movable element into sealing engagement with the outward flow blocking seat.

5. The pump assembly according to claim 1, wherein the check valve comprises:

an outward flow blocking seat in the gas release port;

a movable element path in the gas release port that leads upward relative to the axis to the outward flow blocking seat;

a movable element movable along the movable element path; wherein the movable element is pushed upward along the movable element path into sealing engagement with the outward flow blocking seat in response to liquid well fluid in the standing valve chamber during the power stroke; and the movable path has a greater cross-sectional area than a cross-sectional area of the movable element, providing a gas release passage around the movable element while the movable element is out of sealing engagement with the outward flow blocking seat.

6. The pump assembly according to claim 1, wherein the check valve is free of any biasing spring that biases the check valve to the outward flow blocking position.

7. The pump assembly according to claim 1, wherein the check valve comprises:

an inward flow blocking seat;

an outward flow blocking seat upward from the inward flow blocking seat relative to an axis of the barrel;

a movable element that seals against the inward flow blocking seat while the plunger is in the fill stroke; wherein the movable element is movable along a movable path into sealing engagement with the outward flow blocking seat while the check valve is in the outward flow blocking position; and the movable element is located along the movable element path out of sealing engagement with the inward flow blocking seat and the outward flow blocking seat while the check valve is in the gas release position.

8. The assembly according to claim 1, further comprising:

a housing enclosing the barrel, the housing having a larger inner diameter than an outer diameter of the barrel, defining a housing annulus between the barrel and the housing that is in fluid communication with the standing valve chamber;

a barrel outlet port extending from an interior of the barrel to the housing annulus; wherein during the power stroke, the plunger pushes well fluid in the barrel out the barrel outlet port into the housing annulus and up the housing annulus to the standing valve chamber.

9. A well pump assembly, comprising:

a barrel having an axis;

a plunger carried reciprocally and sealingly in the barrel between a downward moving power stroke and an upward moving fill stroke;

a standing valve acting as a discharge valve, the standing valve having a ball above a seat at an upper end of a standing valve chamber, the standing valve chamber being in fluid communication with an interior of the barrel below the plunger;

a travelling valve carried below the standing valve by the plunger for reciprocating movement therewith, the travelling valve admitting well fluid through the travelling valve into the barrel below the plunger during the fill stroke, the travelling valve closing during the power stroke so that the plunger pushes well fluid from the barrel upward into the standing valve chamber and discharges the well fluid through the standing valve for conveyance up a production tubing;

a gas release port extending from through a sidewall of the standing valve chamber below the ball and the seat of the standing valve to the exterior of the pump assembly; and check valve means in the gas release port for blocking well fluid in the standing valve chamber from exiting through the gas release port while the plunger is in the power stroke and a liquid content in the well fluid in the standing valve chamber is sufficiently high to lift the ball above the seat of the standing valve, and for enabling gas present in the well fluid in the standing valve chamber to flow out the gas release port while the plunger is in the power stroke if a gas content in the well fluid in the standing valve chamber is sufficiently high to prevent lifting of the ball above the seat of the standing valve.

10. The pump assembly according to claim 9, wherein:

the check valve means prevents substantially any liquid from flowing through the gas release port while gas is flowing out the gas release port.

11. The pump assembly according to claim 9, wherein:

the check valve means also blocks well fluid on the exterior of the pump assembly from entering the standing valve chamber through the gas release port while the plunger is in the fill stroke.

12. The pump assembly according to claim 9, wherein the check valve means comprises:

an outward flow blocking seat in the gas release port;

a movable element path in the gas release port that leads upward relative to the axis to the outward flow blocking seat;

a movable element movable along the movable element path; wherein the movable element is pushed upward along the movable element path into sealing engagement with the outward flow blocking seat in response to liquid well fluid in the standing valve chamber during the power stroke; and if the gas content in the well fluid in the standing valve chamber is sufficiently high, the gas will flow around the movable element and out the outward flow blocking seat during the power stroke until the gas content drops sufficiently to cause the liquid well fluid to push the movable element into sealing engagement with the outward flow blocking seat.

* * * * *